US009767948B2

(12) United States Patent
Bromberg et al.

(10) Patent No.: US 9,767,948 B2
(45) Date of Patent: Sep. 19, 2017

(54) LIGHT-WEIGHT, EFFICIENT SUPERCONDUCTING MAGNETIC ENERGY STORAGE SYSTEMS

(71) Applicant: Novum Industria LLC, New York, NY (US)

(72) Inventors: Leslie Bromberg, Sharon, MA (US); Philip C. Michael, Cambridge, MA (US)

(73) Assignee: Novum Industria LLC, New York, NY (US)

( * ) Notice: Subject to any disclaimer, the term of this patent is extended or adjusted under 35 U.S.C. 154(b) by 0 days.

(21) Appl. No.: 14/723,918

(22) Filed: May 28, 2015

(65) Prior Publication Data

US 2016/0049229 A1 Feb. 18, 2016

Related U.S. Application Data

(60) Provisional application No. 62/005,583, filed on May 30, 2014.

(51) Int. Cl.
*H01B 12/00* (2006.01)
*H01F 6/06* (2006.01)

(52) U.S. Cl.
CPC ..... *H01F 6/06* (2013.01)

(58) Field of Classification Search
CPC ..... H01F 6/06
USPC ..... 505/211
See application file for complete search history.

(56) References Cited

U.S. PATENT DOCUMENTS

| | | | |
|---|---|---|---|
| 3,919,677 | A | 11/1975 | Young et al. |
| 4,920,095 | A | 4/1990 | Ishigaki et al. |
| 5,410,287 | A | 4/1995 | Laskaris et al. |
| 5,581,220 | A | 12/1996 | Rodenbush et al. |
| 2010/0029487 | A1 | 2/2010 | Kobayashi |
| 2011/0263432 | A1 | 10/2011 | Usoskin et al. |

FOREIGN PATENT DOCUMENTS

| | | | |
|---|---|---|---|
| WO | 2013180802 | A1 | 12/2013 |

OTHER PUBLICATIONS

International Search Report and Written Opinion mailed Aug. 14, 2015 in co-pending application No. PCT/US2015/033187.

*Primary Examiner* — Paul Wartalowicz
(74) *Attorney, Agent, or Firm* — Nields, Lemack & Frame, LLC

(57) ABSTRACT

Novel configurations to improve the performance of superconducting magnetic energy storage system are described. The use of poloidal grading of the conductor, enabled by the use of $2^{nd}$ generation YBCO conductors, is described. Methods to improve system performance when limited by the critical field of the superconductor are described, using optimized thin winding pack and thick winding pack toroidal geometries, where a uniform or near uniform magnetic field can be generated in a torus. Configurations that minimize structural requirements, weight and costs are also described. Cryostat innovations useful with toroidal systems are provided.

10 Claims, 11 Drawing Sheets

LIGHT-WEIGHT, EFFICIENT SUPERCONDUCTING MAGNETIC ENERGY STORAGE SYSTEMS

This application claims priority of U.S. Provisional Patent Application Ser. No. 62/005,583, filed May 30, 2014, the disclosure of which is incorporated herein by reference in its entirety.

FIELD

Embodiments of the present disclosure relate to superconducting magnetic energy storage systems (SMES), and more particularly, structures that improve performance while reducing reduce cost and weight.

BACKGROUND

Under DC conditions, superconducting magnets have minimal losses and are extremely stable, and thus provide an efficient device for storing energy. A principal application for Superconducting Magnetic Energy Storage (SMES) is to provide intermittent power, especially for applications requiring limited duration of high peak power. Unlike battery back-up systems, the energy storage capacity of a SMES does not deteriorate over time. A further important advantage is that a SMES device can discharge to, or be charged from, an electric utility power grid at exceptionally high power rates with very high round-trip efficiency.

Superconducting Magnetic Energy Storage (SMES) systems provide rapid response to charge and discharge operations but, unlike other technologies, the energy available is independent of the discharge rate. The system is deployable and can be scaled from small units to very large units and, unlike other technologies, the unit cost per unit stored energy decreases with increasing size. The scalability of this technology offers the advantage of being able to cover a large spectrum of the energy-power requirements for storage systems, from less than a megawatt (MW) to thousands of MW with storage times spanning from minutes to hours, and fast discharge times, on the order of fractions of a second.

In recent years, there have been major advances in both low-temperature superconductors (LTS), and in the newer high-temperature superconductors (HTS). The Department of Energy programs in electric energy systems, magnetic confinement fusion technology, and accelerator technology for high-energy physics (HEP), have been instrumental in advancing HTS technology.

It would be advantageous if it were possible to take advantage of these large investments and apply them to electricity storage systems for electric utility power grids.

SUMMARY

Options to reduce the cost of the magnets and systems used for superconducting magnetic energy storage (SMES) systems, especially those manufactured using high temperature superconductors (HTS), are described. Several conceptual improvements for SMES systems are described. A 10 MJ (1 MW, 10 seconds) system has been designed. The design includes all components required for a successful integration of the SMES system on the grid with expertise spanning from superconducting materials, current leads, cryogenics, and power conversion equipment.

This disclosure describes means to integrate a toroid magnet with power extraction leads that results in efficient operation, with small average cryogenic cooling requirements, coupled to a superconducting (SC) distribution system.

A toroidal magnet system is an attractive option for a SMES system. It has all of the intrinsic advantage of SMES: 1) low idling losses, 2) rapid response, and 3) high overall efficiency. It has the additional advantages of very low fringe field and relatively low cryostat cost.

The majority of early demonstrations of SMES technology have been based on NbTi wire, with a few more recent demonstrations performed with first generation (1G) BSCCO wire and, more recently, YBCO $2^{nd}$ generation coated conductors. Both LTS and HTS materials have significantly improved since these demonstrations were completed. There have been several earlier prototypes with some actually connected to relevant, operational power systems. Micro-SMES units storing one or a few megajoules are in commercial operation.

The superconductor of most recent interest for power grid applications is the second-generation (2G) HTS, coated conductor tape made from YBCO. Although the first generation (1G) HTS made from BSCCO by the powder-in-tube process has a much longer development history, its production has been abandoned in the U.S., and replaced by 2G YBCO wire due to the high cost of the silver matrix needed for BSCCO and the superior performance of YBCO, especially at high magnetic field. The coated tape geometry provides excellent mechanical strength for coil manufacture and operation due to the reduced strain in the superconducting layer that is deposited on a high strength nickel alloy substrate.

One limitation to the more wide spread deployment of SMES is the energy needed to cool the current leads to the device. Most electric power applications operate at relatively low voltages compared to those in a high tension distribution grid. To obtain high power at low voltage, high currents are required. It is well known that optimized current leads from room temperature to the cryogenic temperatures suitable for SC magnets or for superconducting current leads are about 0.1 W/A per lead pair (from room temperature to about 65 K). Thus, a system operating at 10 kA would have a continuous heat leak of about 1 kW if energized (i.e., current flowing), or 700 W if not (during idle), requiring a large refrigerator. For 20% Carnot efficiency (for highly efficient cryocoolers), even at 80 K the required continuous electric input power to the refrigerator is over 10 kW. If the system is intended to be used with low duty cycle, a substantial fraction of the energy stored in the SMES would be consumed to cool the current leads.

This disclosure described techniques and structures that take advantage of extensive prior DOE investments in advanced superconducting magnet technology developed for magnetic confinement fusion, and high energy physics accelerator applications, and apply them to SMES applications.

One objective has been to incorporate innovative options for addressing some of the difficulties associated with SMES systems, starting from basic rules. Efficient magnets (structurally efficient, for weight minimization) are proposed, as well as means to couple the energy out using techniques appropriate for short pulse length, and conductor design for improved thermal stability.

BRIEF DESCRIPTION OF THE FIGURES

For a better understanding of the present disclosure, reference is made to the accompanying drawings, which are incorporated herein by reference and in which.

DETAILED DESCRIPTION

YBCO Conductor Performance

Figure 1A:
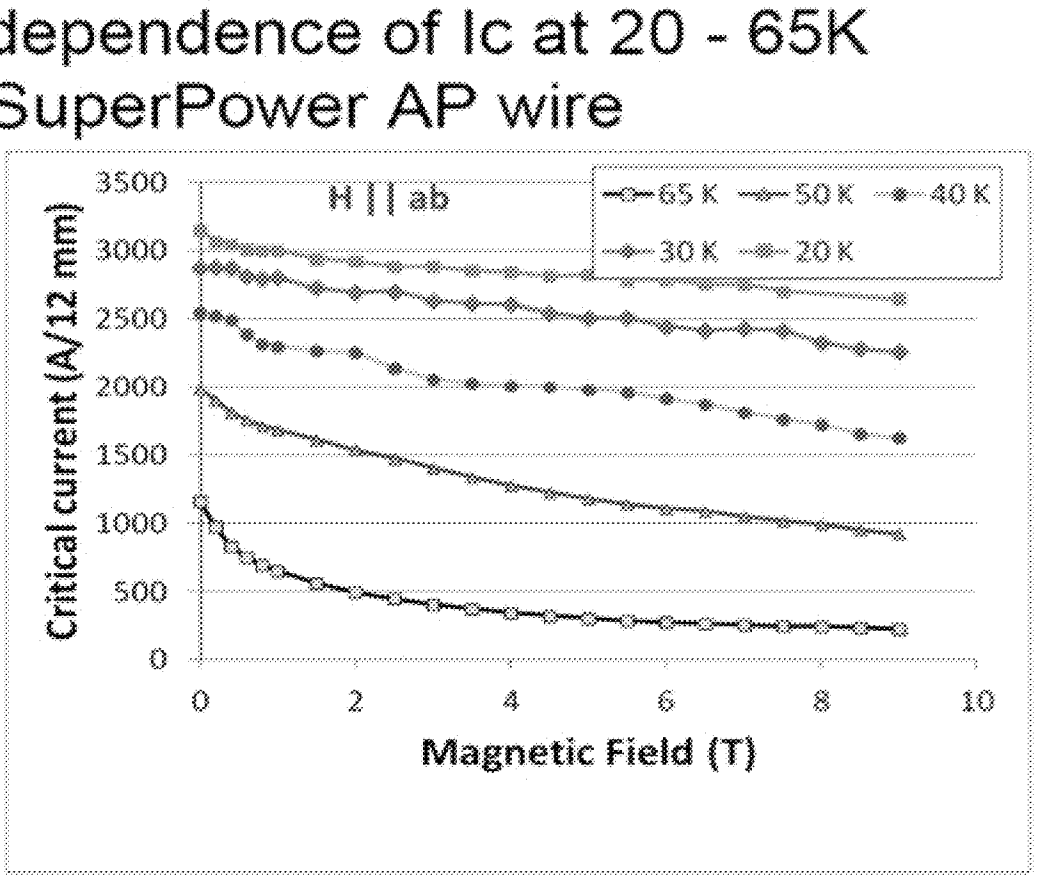
Figure 1A (Prior Art)
FIGS. 1A-1B show representative critical current values for 12 mm wide $2^{nd}$ generation SuperPower tapes as a function of magnetic field at different temperatures.
Figure 1B:
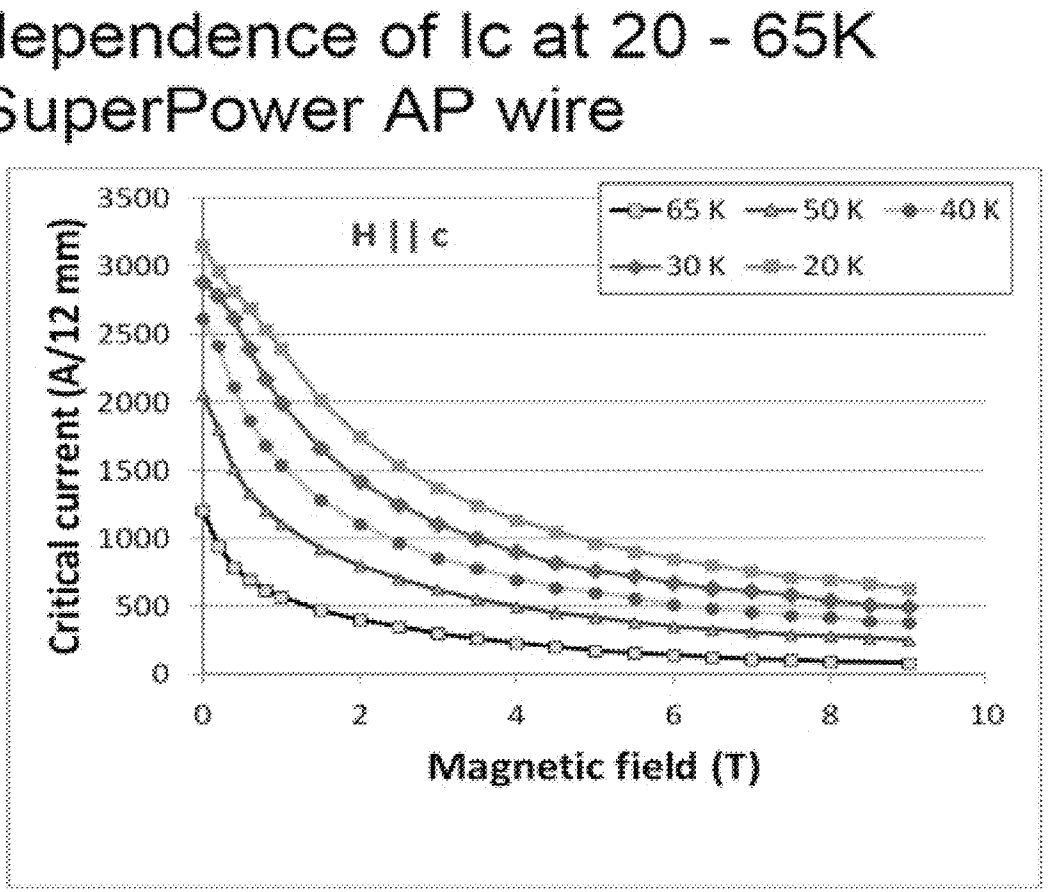
Figure 1B (Prior Art)

FIGS. 1A-1B show the representative critical current values for 12 mm wide $2^{nd}$ generation SuperPower tapes as a function of magnetic field at different temperatures. In FIG. 1A, the magnetic fields are parallel to the superconducting tape, while in FIG. 1B, the magnetic field is perpendicular to the tapes. For temperatures greater than about 40 K, the critical current shows substantial field dependence. For temperatures greater than about 40 K, substantial savings could be achieved if the conductor dimensions are graded to better match the critical current of the tape to its local magnetic field. More specifically, at magnetic fields greater than about 1 T, there is a substantial decrease in critical current when the magnetic field is perpendicular to the tapes.

Tape Orientation

Based on this, the tapes should be oriented so that the toroidal magnetic field is mainly parallel to the tape. When the tapes are arranged with the thin dimension in the radial direction, then the current density capability is higher. This approach has the advantage that the tapes/conductor can be easily shaped to follow the desired contour, as the bending is in the thin direction of the tapes. Alternative approaches, such as those with the CORC or the twist-stacked tape cable conductor, can also be used, but in that case, the orientation of the tapes with respect to the toroidal field varies, and is in some sections of the tapes, is perpendicular to the field (in the "bad" direction shown in FIG. 1B).

Substantial improvements in current capabilities can be achieved if the tapes are wound in this field-oriented direction. For example, at 50 K and 4 T, if the field is parallel to the tapes, the critical current is about 1300 A. If the field is perpendicular to the tapes, the critical current is only 500 A.

Conductor Grading in Toroidal Wound SMES Coils

In toroidal magnets, the magnetic field is highest at the low major radius, and decreases towards the outer region (larger major radius) of the magnets. In addition, the innermost turn (closest to the minor axis of the torus) has the highest field, and the field decreases towards the outer turns (towards the periphery of the magnet).

There are two methods for grading the superconductor, grading by layers and grading by poloidal winding angle. For grading by layer, the conductor is graded, by continuously reducing the width of the tape or the number of tapes as the tapes travel from the bore of the magnet to the periphery (the bore of the magnet being defined as the interior region of the torus, the periphery of the magnet being the outer region of the torus, near the surface). With conventional strands, the option for grading is to change the strand properties (including the type of superconductor) and/or the number of strands in the cable. HTS ($2^{nd}$ generation YBCO) enables the adjustment of the width of the tapes, to make use of the higher current density capability of the superconductor at lower fields.

Figure 2:
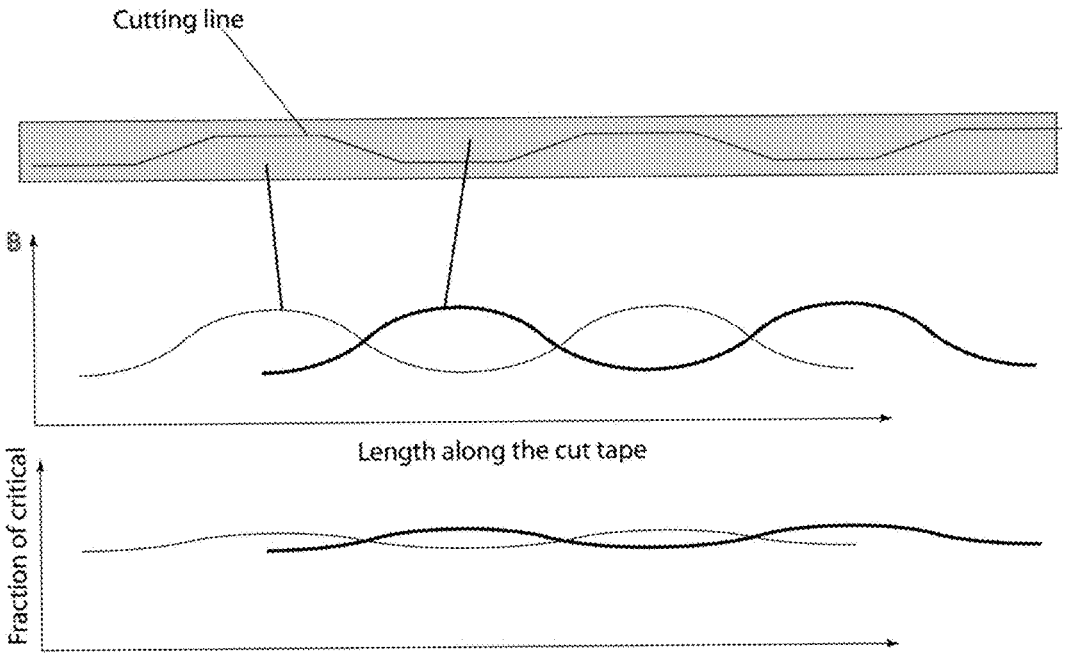
FIG. 2 is a schematic diagram of a proposed method for adjusting HTS tapes to local fields in toroidal magnets.

For an HTS toroidal winding, grading can also be obtained by varying the widths of tapes as they wrap around the toroid, as shown in FIG. 2. This approach is unique to YBCO $2^{nd}$ generation tapes and similar tapes, such as ReBCO; it is not feasible with conventional strands or with tape with MgB2 or BSCCO superconductor (with filaments), as the filaments would be severed during the cutting process. The widest section of the tape would be placed along the innermost leg of the winding, while the thinner section would be placed towards the outer leg of the winding, where the local magnetic field is lower. The poloidal grading can be used that adjusts the critical current of the superconductor, in order to match the varying magnetic field, B, along the conductor, as shown in FIG. 2. A factor of about 4 in tape width can be achieved, since tape is available with 12 mm widths down to about 3 mm widths. Substantial savings can be achieved in this manner, both in total conductor used and in weight. The technique is useful either when the magnet is layer-wound or pancake wound. In the case of layer wound, the tape would experience the same field variation along the turns of the layer. Thus the tape profile (width) would be the same in all the turns of the layer, along a tape. In the case of pancake wound, the tape profile in adjacent turns will vary, as the innermost turns experience higher fields than the outer turns of the pancake.

The tapes need to be "sliced" with a wave, such that the tapes are widest in the high field region and thinnest at the low field region. As in the previous grading, the object is both to decrease the amount of superconductor required and the weight.

Grading has been used in high field fusion magnet designs, as well as in other conventional magnets. In particular, toroidal field magnets with peak fields over 18 T have been designed using grading, while minimizing the amount of superconductor by grading.

However, the grading is achieved in those designs by adjusting the conductor type (for example, from Nb3Sn in the high field region to NbTi in the low field region), or in the characteristics of the conductor (e.g., the number of strands in the cable). Joints between conductor grades are needed for both of these solutions, which are usually resistive joints. Epitaxially deposited superconductors, and in particular, YBCO or ReBCO type conductors, allow the possibility of adjusting the conductor properties by simply adjusting the width of the superconductor. By appropriate design of how wide the conductors (tapes) are slit, it is possible to adjust the current sharing conditions of the tapes to the local magnetic field, while carrying the same current. Adjusting the ratio of current to critical current is useful for protection and stability of the superconductor. In particular, it is important for coils that depend on quick normal-to-superconductor transition over a large area of the magnet, for both quench detection as well as protection. In the case of externally induced transition, keeping the superconductor at conditions where it is close to critical over a substantial area of the coil is attractive in that reduced amount of energy (and time to deliver the energy) is required to initiate an energy dump (either internal or external dump).

FIG. 2 refers to variations in a coil geometry that has a fast change of field along the conductor (such as a torus, with a high field in the inner leg and a lower field in the outer leg). However, the technique can be used to adjust the tape width in a coil where the fields are higher in the inner bore than the periphery, such as a solenoid made from pancakes. Such conditions occur both in solenoids as well as toroids, where the field in the bore of the magnet is higher than at the periphery of the magnet. In that situation, the tape width can be decreased as the turns in the coil move away from the inner bore to the periphery. The resulting variable width tapes (after the slitting process) can be used so that the wider tapes are used in the high field region of the coil, and the narrow tapes at the periphery. Substantial saving in required quantity of tape can be achieved by this type of winding, with the additional benefit of improved quench detection/protection.

The tapes can be used individually, with insulation on each tape, or they can be stacked together in a cable (with or without twist, as in the TSTC cabling method) or in a cable wound helically with tapes, as in CORC. In the case of cables, the simulation is over the cable. Both TSTC and CORC cables offer some transposition of the tapes, assisting in current distribution among the tapes.

FIG. 2 indicates only one cut in the width of the tape. It should be clear that if the tape is even wider, multiple cuts may be made in the tape, resulting with more than 2 variable-width tapes.

In summary, in order to minimize the amount of superconductor used, the following approach is used:

Grading of the tapes by varying the width of the tape as it varies poloidally along the torus. The torus will be layer wound, thus one layer at a time, with similar performance Adjusting the width of the tapes of different layers (the magnitude of the field decreases in the outer layers, making it possible to use narrower tapes in the outer layers of the winding).

In this manner, the tape width can be adjusted so that it is a constant fraction of critical current everywhere. We estimate a SAVING OF ABOUT 2 times the amount of superconductor required, depending on operating temperature! At lower temperatures, where the current density is not a strong function of the magnetic field, the impact of grading, either poloidal or by layer, is diminished.

Thin Winding Pack

First, an option when the winding pack is thin with respect to the size of the torus, as in a conventional toroidal winding for fusion machines, is described. Also, the strength of the tapes is used to support the electromagnetic loads, minimizing the need for additional structural material and thus saving weight. In this case, the coil is roughly D-shaped (as described below).

Table 1 shows preliminary design of a 10 MJ SMES. It is assumed that the device is a torus, with elongation equal to 2 (elongation is the ratio of coil height to width). The field on the toroidal axis (r=0.75 m) is 2.7 T. The peak field, at the inboard of the torus, is 5 T, while the field on the outboard side is about 1.9 T. The total current in the toroidal field coil is about 10 MA-turns. The number of tapes required is determined by the total current and the current on the tapes.

Table 1 shows three cases:

1. no grading,
2. poloidal grading and
3. both by-layer and poloidal grading.

Also, two temperatures are indicated; 50 K and 65 K. The total length of the HTS required, the present cost and the weight of the superconductor is indicated on the table.

TABLE 1

Illustrative parameters of SMES coil (10 MJ); layer wound with HTS tapes with wide dimension parallel to the magnetic field (to orient the magnetic field in the ab plane)

| | | |
|---|---|---|
| major radius | m | 0.75 |
| minor radius | m | 0.35 |
| elongation | | 2 |
| Field at 0.75 m | | 2.7 |
| Energy (MJ) | MJ | 10 |

| | | no grading | | poloidal grading | | radial/poloidal grading | |
|---|---|---|---|---|---|---|---|
| Operation at critical | | 65K | 50K | 65K | 50K | 65K | 50K |
| Conductor required | km | 105 | 26 | 57 | 20 | 36 | 17 |
| Cost of conductor | M$ | 10.5 | 2.6 | 5.7 | 2.0 | 3.6 | 1.7 |
| Weight of conductor | kg | 982 | 246 | 693 | 211 | 436 | 187 |

The performance of a 50 MJ unit is shown in Table 2. To minimize the HTS cost, both 20K and 50K operation are considered. Even in the case of low temperature and grading, the cost of the superconductor material required is expensive, and may be more than 2 million dollars.

At the lower temperature, because the critical current is not strongly dependent on the field, the impact of grading of the superconductor is minor compared to the case of 50 K or 65 K temperature operation. Conversely, refrigeration costs are higher for operation at 20 K compared to those at 50 K or 65 K.

For the 50 MJ SMES, the superconductor substrate is not strong enough to support the electromagnetic loads. In this case, it is necessary to provide additional support (for the tensile loads). The additional material increases the weight of the system. For the parameters in Table 2, it is expected that the weight of the additional tensional support (along the toroid) is about 3 times that of the superconductor. In addition, the structure to support the centering loads on the toroidal coils needs to be included in the total system weight.

TABLE 2

Operation parameters for a 50 MJ SMES at 20K and 50K

| | | |
|---|---|---|
| major radius | m | 1 |
| minor radius | m | 0.47 |
| elongation | | 2 |
| Field at 1 m | | 4 |
| Energy (MJ) | MJ | |

| | | no grading | | poloidal grading | | radial/poloidal grading | |
|---|---|---|---|---|---|---|---|
| Operation at critical | | 20K | 50K | 20K | 50K | 20K | 50K |
| Conductor required | km | 31 | 83 | 29 | 55 | 28 | 47 |
| Cost of conductor | M$ | 3.1 | 8.3 | 2.9 | 5.5 | 2.8 | 4.7 |
| Weight of conductor | kg | 288 | 776 | 277 | 621 | 268 | 532 |

It may be advantageous, for some applications, to electrically split the SMES toroidal magnet into multiple coils. However, this approach may have additional structural issue in the case that the currents are not well balanced among the coils, for instance during emergency discharge of the system current. A better approach may be to wind the multiple coils as layers of the torus ("layer winding" or "shell approach", as opposed to "pancake winding"). In this case, the loads would be balanced, even if the currents in the different coils are unbalanced.

Optimization when Performance is Limited by Peak Field at the Conductor

Thin Winding Pack

When the superconductor operates near its superconducting limit, it is of interest to optimize the performance of the SMES for a given peak field. Assuming a simple geometry, such as a racetrack (picture-frame) coil, it is straight forward to determine that the energy in the system as:

$$E^{\sim}(2\pi/2\mu_o)hB_o^2R_o^2\ln(R_{out}/R_o)$$

where h is the height of the coils, $B_o$ is the maximum field at $R_o$, the throat of the magnet, $R_{out}=R_o+2a$ is the outermost radius of the coil, and a is the half radial width of the coil (the formula assumes that the conductor winding is a small fraction of the area occupied by the SMES). It is instructive to determine the maximum energy that can be stored in a system that is limited by the maximum field at the conductor ($B_0$). In this case, the energy maximizes when:

$$\ln(R_{out}/R_o)=0.5$$

or $$R_{out}/R_o\sim1.65$$

This represents a machine with a relatively high aspect ratio, and is applicable when the coil winding is thin. It should be noted that the unoccupied space inside the throat of the magnet that is not used to produce magnetic field is a significant fraction of the total system volume. Even with a very thin coil winding, the region that is not used is about 60% of the total volume. Thus, it would be useful to develop concepts that will use the allowed space more efficiently.

Thick Winding Pack

An alternative approach is to use a thick coil winding. It is possible to maintain a constant or near constant value of the magnetic field inside a toroidal geometry if there is current distributed throughout the space within the coil outline. It is easy to show that if there is a current within the coil volume that scales as $$J(R)=B_0/(\mu_0R)$$

then the field is constant throughout the volume and $B_0$ is the constant magnetic field. The current density J(R) is the toroidally averaged current density at a given radius R. That is, the current does not have to be uniform toroidally, it can be lumped in discrete elements. Thus, the magnet would look like the one shown in FIG. 3*a*, for a race-track wound magnet. There is a winding 10 that quickly brings the field to the maximum field on the superconductor. Without additional current, the field would decrease as 1/R. But by placing conductors (field-bumping loops 11) inside the volume, it is possible to maintain a near constant magnetic field across the coil width, substantially increasing the magnetic field storage capability of the device, by at least several times that of the optimized thin winding described above. The main axis of the coil is to the right, and the major radius increases towards the left hand side of FIG. 3*a*. The toroidal magnetic field is also shown in FIG. 3*b*. In between the conventional toroidal winding 10 and the field bumping turn 11, as well as between the field bumping turns 11, the field decreases as 1/R, as in conventional toroidal topologies. The distribution of the field-bumping turns 11 can be adjusted so that the toroidal magnetic field is nearly constant, as shown in FIG. 3*b*.

Figure 3A:
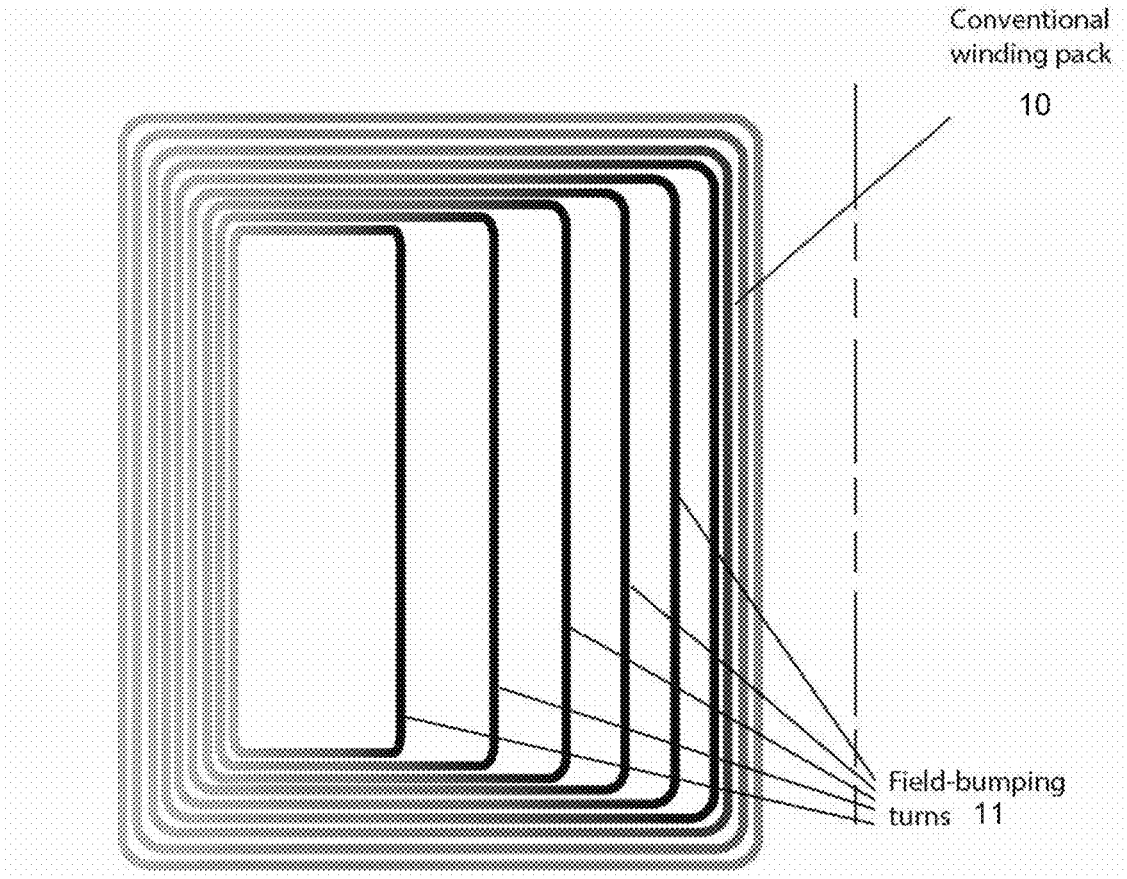
FIG. 3*a* shows a toroidal magnet having a nearly uniform magnetic field.
Figure 3B:
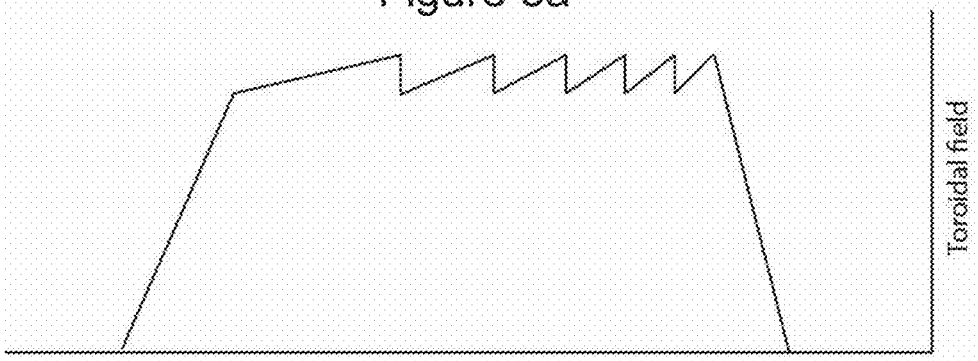
FIG. 3*b* shows the resultant magnetic field for the magnet of FIG. 3*a;*

In practice, as shown in FIG. 3*a*, the spacing between bumping turns 11 may be adjusted to result in the maximum energy storage for a given envelope. In the conventional winding 10 (which comprises the outermost turns of the coil), the conductors would be placed as tightly as possible, as in conventional toroidal magnets. In the inner region, the spacing between the bumping turns 11 will be adjusted to provide constant (or near constant) magnetic field.

As the peak field is relatively constant in the bore of the magnet, layer-grading is of limited value. The field does decrease in the periphery region, and thus, there could be advantageous to use some poloidal grading, as described above. In the outer region of the winding (the conventional winding 10), the field in the inner leg of the magnet does vary (decreasing as they progress towards the outside of the magnet). Thus, grading that region of the coil is useful for minimizing the weight and cost of the system (by decreasing the amount of conductor required). It is useful to have the margin of the superconductor (i.e. fraction of critical current) throughout the coil be within a relatively narrow range.

The description above describes conditions that result in a magnetic field that is, on the average, constant as a function of radius for a substantial fraction of the volume of the coil. However, it results in local fields that are substantially higher at the conductor, and in practice, near discontinuities of the current density. Since the maximum magnitude of the field determines the conductor requirement, there are conditions where the performance of the coil (or the characteristics of the conductor) are limited by the LOCAL magnetic fields. This situation results in choice of different optimization requirement, where the average field ceases to be constant and instead, the current density of the coils is adjusted to minimize peaking of the field. Field peaking is eliminated in the case of shell-type winding (i.e., layer wound, shown in FIG. 4 and discussed below). In the case of "pancake" winding (or plate winding, where plates are used with conductors placed in its surface), localized peaking can increase the field by factors of 2 or higher. By adjusting the current distribution in the plates (such as, for example, by adjusting the location of the strands/cables in the plates), it is possible to minimize the field peaking, at the expense of reduced overall field (and thus, stored energy), but decreasing the net field peaking. A large amount of the peaking is due to the high current density of the outer region (periphery) of the magnet, where the current flows in the reverse direction. There is a loss of stored energy, as the magnetic field is locally decreased.

Field peaking can be decreased by spreading the current in the periphery region. The current can be returned in a location that is thicker than in the bore of the magnet, by making use of the large unused space in the periphery of the magnet. An alternative approach is to use a hybrid magnet, using a shell winding, that establishes the 1/R toroidal field, in combinations with radial or near radial plates that generate the near constant toroidal field in the bore of the magnet. The toroidal shell can be split into several sectors, on which the superconductor is placed in a layer-type winding pattern (one or multiple layers, as required). One or more radial plates are inserted within each toroidal sector, or located at one or both ends of the sector. The radial plates introduce the currents required for producing the near uniform field. Because the current in the periphery of the magnet is distributed in the toroidal direction, the peaking is now due exclusively to the plates that produce the uniform field. The amount of peaking is determined by the details of the magnet, such as the number of plates, the current distribution in the plates, the location and current density and distribution of the current in the periphery of the magnets, and other issues. In the case with 10 plates, for example, for plates with 3 zones (high field region, constant field region and return leg), the peaking can be as high as 4, peaking in the region where there is current discontinuities (in the region between zones). The peaking can be decreased by a large factor, by as much as a factor 4 or more, with peaking as low as 1.3 times that of the ideal uniform field toroid, for the case of 10 plates, for the case with current flowing in the shell that generates the 1/r field and only current that produce the uniform field flowing in the plates. Furthermore, by increasing the number of plates to 20, the peaking can be as low as 1.1. In this case, the energy stored in the magnet, for a given peak value of the magnetic field, is about twice that in the optimized conventional magnet with a 1/R field.

The shells and the plates of the hybrid magnet can be connected mechanically for rigidity and support. The hybrid magnet with one shell and multiple radial plates is structurally attractive. The shell can be made from multiple sectors. The sector shells maintain the plates in their appropriate location, while the radial plates can be used to balance the radially and vertically induced loads in the shells, loads that are "inplane" with respect to the radial plates.

In addition to being structurally rigid, the hybrid magnet shell sectors and radial plates can be connected thermally in order to provide means of conduction cooling the magnet, without the need of flowing cryogens.

In this case, the winding is distributed throughout the major radius of the magnet (as opposed to the conventional magnet, where the winding is limited to the throat of the magnet and to the outer leg). The turns need to be supported. Means of supporting these turns are described later.

Figure 4:
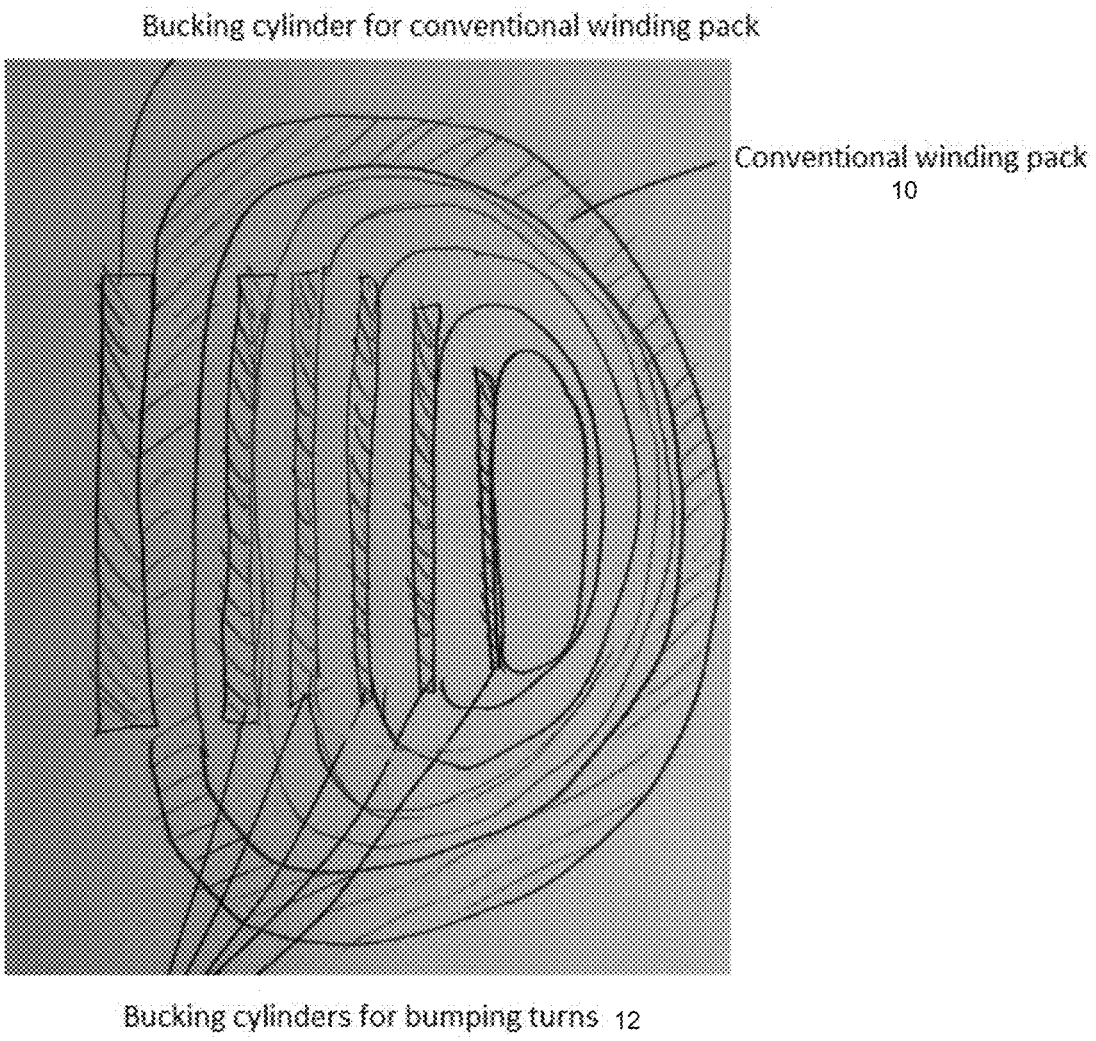
FIG. 4 shows nested D-shaped coils for generation of nearly constant magnet field in a toroidal geometry.

Although FIG. 3*a* has been shown for picture frame coils, it is possible to use any other geometries. In particular, it is possible to use D-shape coils. FIG. 4 shows the D-shape, nested bumping coils 12. In this case, the toroidal axis is towards the left hand side of FIG. 4.

Current Leads and Energy Coupling

There are several ways to decrease the refrigerator power required for the current leads for pulsed power applications:

1. Large overcurrent leads (applicable only if main coils have low current leads);
2. Inductive coupling to room temperature secondary with low current primary; and
3. Vacuum tube current leads.

The first and third options are attractive for applications with low duty cycle, where the energy is needed quickly but with long charging times. The second option is attractive for general applications, and may be the most efficient system.

To minimize the parasitic energy consumption, it is possible to adjust the current flowing through the current leads. The resistive part of the current lead (from room temperature to the temperature where a superconducting current lead can be used) contributes about 100 W per kA of thermal load, per current lead pair. The current and the operating voltage of the unit can be adjusted to match the required power flow. For a 50 kW system, for example, using 500 V peak discharge voltage, facilitates the switching (no need of solid state component ladders such as IGBT, MOSFET, or others, needed for the power conversion), and thus would operate at 100 A. A system operating at 1 MW, would need higher voltage and operating current. The current lead, in some high current cases, could dominate the refrigerator power requirement.

Quench Protection Considerations

In the case of low current operation, quench protection can be achieved through internal dump, by driving the coil normal so that a substantial fraction of the conductor and structure heats up, distributing the energy over a relatively large mass and limiting the peak temperatures. The coil can be driven normal by increasing temperature (resistive elements, inductive heating), or by the application of magnetic fields that drive the conductor normal. In the case of tie-plates (discussed below in the structure section), induced currents could flow on the structure to allow fast discharge of the coil without large voltage drops, as the process would generate eddy current in the tie-plates that would decrease the voltage experienced by the superconductor or the leads. Those currents would decay in a longer time scale. The approach can be used when the discharge time during normal operation is long compared to the dump time needed for protection.

Power Conditioning Requirements

Inductive coupling can be used to minimize the cryogenic load to the system. This approach seems to be well suited for the SMES application, in that, in principle, it can avoid the issues with high capacity current leads. It is, however, best suited for low duty cycle applications, as it is more difficult to use for fast storage.

To isolate the multiple coils in the SMES system, it is possible to use power conditioning equipment at either room or cryogenic temperature. The tradeoff is complex, as it may be possible, for certain low duty, short pulse applications, to pursue high performance from electronic components, as suggested by Patterson and Haldar, and used in the XRAM concept.

It is possible to use additional schemes to extract the energy from the magnet. One such approach is the XRAM option, where a SMES made from multiple coils are charged in series (low current), but discharged in parallel (high current). This concept can be achieved by superconducting switching over lines that connect different sections of the toroid magnet. This option may be especially useful during the initial charging of the thick winding option presented in FIG. 3*a*, as a means to gradually energize the system to its rather high magnetic energy storage density capability. Superconducting Systems, Inc. (SSI) has switching techniques that it uses in manufacturing of persistent mode MRI magnets that can help in this effort. Another factor that plays into this option is the fact that HTS tapes come in discrete, relatively short, lengths and therefore a given SMES magnet will have many joints where superconducting switching may be employed.

Cryogenics and Stability

The use of HTS materials is very attractive as temperatures higher than 4 K can be used. It is, however, clear that for relatively high performance applications (with magnetic fields greater than a few Teslas), a temperature lower than 77 K, and even lower than 65 K (for freezing nitrogen) need to be used. Some cooling options are liquid/gaseous neon, liquid/gaseous hydrogen and gaseous helium operating at temperature up to 40K.

For heat removal capability, it is difficult to duplicate the high performance of liquids with gas. Liquids have significantly higher density and thus can provide much higher mass flow at given flow velocity compared to cooling with gas. Liquids can remove heat by convection and conduction, with high values of surface heat transfer coefficient. With gaseous coolants, very low heat inputs may result in relatively long term heating of cables/magnets. This is important because of the AC losses that the coil will experience during fast ramp rates (either charging or discharging).

The cryogenic system could take advantage of liquid cooling, without the need of using liquids in the cooling loop by placing a cryogen within a sealed structure; the sealed structure could be in the shape of bladders, set of planar plates sealed at the edges, hollow bars, or tubes. The superconductor could be placed in the same sealed containment, or next to it. The cryogen will be loaded at high pressure when at room temperature. When cooled, the high pressure gas becomes liquid, with good heat transfer coefficient to the cable and with substantial thermal capacity, providing improved cryostability to the superconductor. The average heat can be removed by either conduction cooling or by a heat exchanged to a gaseous coolant. This cryogenic sealed technology can be used with helium, hydrogen and/or neon.

Cryogenics and Superconductor Stability

Different coolants can be used to provide cooling of the superconductor: high pressure helium gas, liquid hydrogen and/or liquid neon pools. Sub-units will be sealed and pressurized with a gas at room temperature. The sub-units could be vessels that surround one or more coils of a toroidal SMES made from discrete coils, or it could be a CICC-type cable that is used for making the coils. The goal is to minimize the thickness and weight of the pressure vessel, by limiting the typical size of the vessel.

In addition to providing rigidity, the high-pressure liquid can also serve as a good dielectric media, much better than that provided by gases (and in particular, helium or neon gases).

Structural Considerations

The toroidal magnet approach for SMES is highly efficient. Even if it were not the most efficient, for the present application, the self-shielding aspect of toroidal magnets is a very key aspect of the approach. The Virial stress (Energy stored in the magnet divided by its volume) provides a guidance to the structural requirement for an efficient structure. The Virial stress is in stress units. Basically, it establishes a minimum volume (and thus, mass) needed to contain a given stored energy, w.

Structurally, efficient toroidal magnets can be constructed with D-shape coils (bending-free magnets). The lack of bending, and the support of the loads through tension in the coil (with the exception of the net radial load present in tori), provides for a highly efficiency structure. Light magnets could be designed if the tapes themselves (over half of the tape sections are high strength nickel-based alloys) can carry the loads, through tension, in D-shape coils. The only additional structure would be a structure to take the net centering load. In practice, there is a need for a small structure, but it is mostly for assembly and taking of the out-of-plane loads, which are small. The tension is constant along the tape. This is the case for low energy SMESs.

When the HTS conductor ($2^{nd}$ generation YBCO) can carry its own loads, as described above for the relatively small SMES units, little additional support is required, and the weight is minimized by using D-shaped coils, where the HTS tapes are flexible and can be loaded in tension (with no bending). However, in the cases of higher fields or larger units, the conductor itself cannot carry the full loads. For ease of analysis, the vertical loads (in the main axis direction) are distinguished from the radial loads. They will be considered separately.

Figure 5:
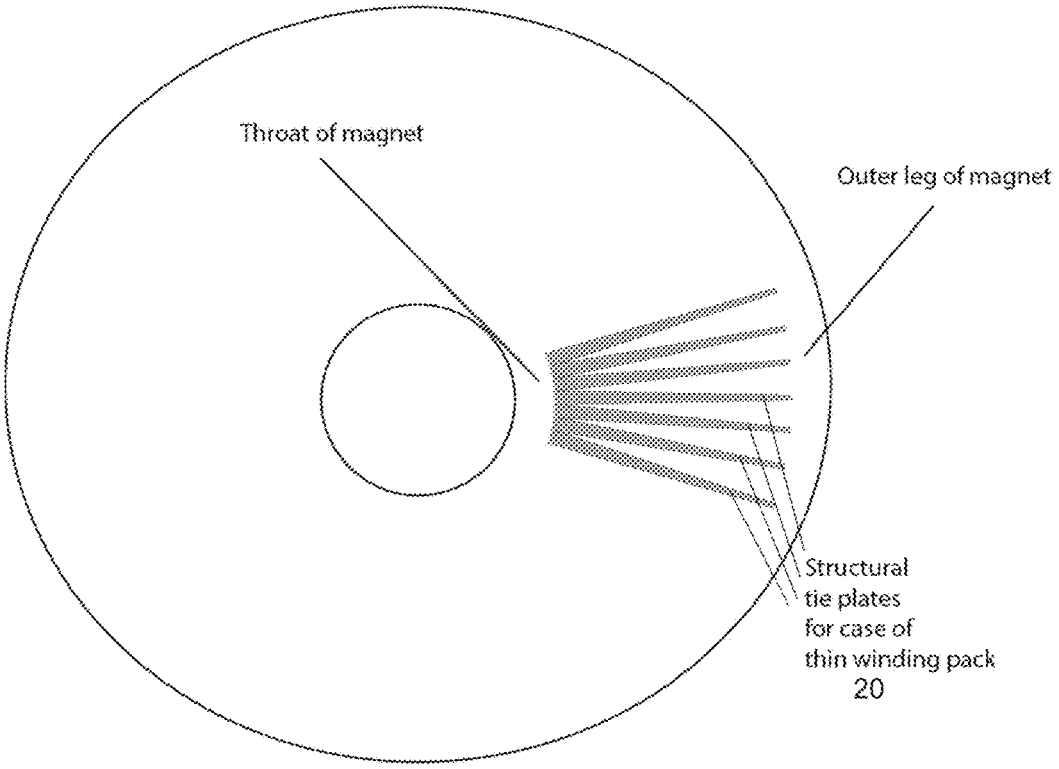
FIG. 5 illustrates structural tie-plates for use with thin winding pack.

For the vertical loads, the forces are mostly generated by the horizontal sections of the magnet. The vertical pressure scales as $1/R^2$, where R is the major radius, as the magnetic field scales as 1/R. Ideally, the structure would tie the top and bottom horizontal legs through the volume of the magnet. To minimize the weight of the device, the structure should be constant through the coil width, and in tension. If it were not, the thickness of the structure could be decreased, increasing the stress and decreasing the weight. In order to maintain constant stress, radial tie-plates 20 would have to decrease in thickness as 1/R, as shown schematically in FIG. 5. The tie-plates 20 have thickness that varies with radius.

Figure 6:
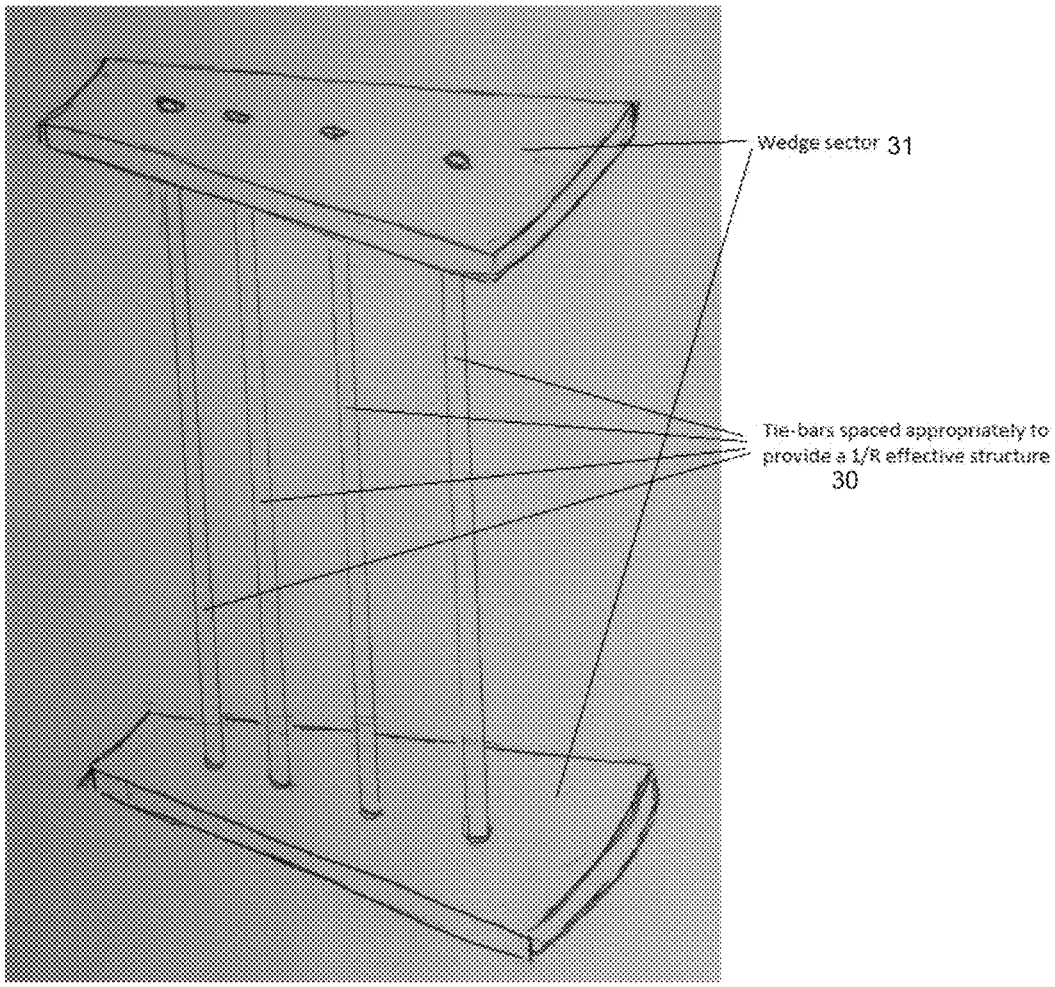
FIG. 6 shows the structural tie-bars spaced appropriately for an effective cross section of 1/R.

Other vertical support options could be used, as long as the effective support thickness varies approximately as 1/R. For example, instead of radial plates, it would be useful to use toroidal plates, or just cable ties, as shown in FIG. 6 (only the structure to support the vertical loads is shown in FIG. 6). In FIG. 6, the magnet throat may be toward the left side of the figure. Tie-rods or tie-bars 30 allow the use of very high strength materials that are only made as fiber (see below). The relatively low modulus can be tolerated by the design. The use of tie-plates 31 (also known as wedge sectors) can be compromised when the discharge time of the SMES is short, as currents will be induced in the plates. However, when the discharge time is long compared to the current diffusion time in the structural tie-plates 31, then the tie-plates 31 could actually be used for protection, not affecting the normal discharge of the SMES.

Figure 7:
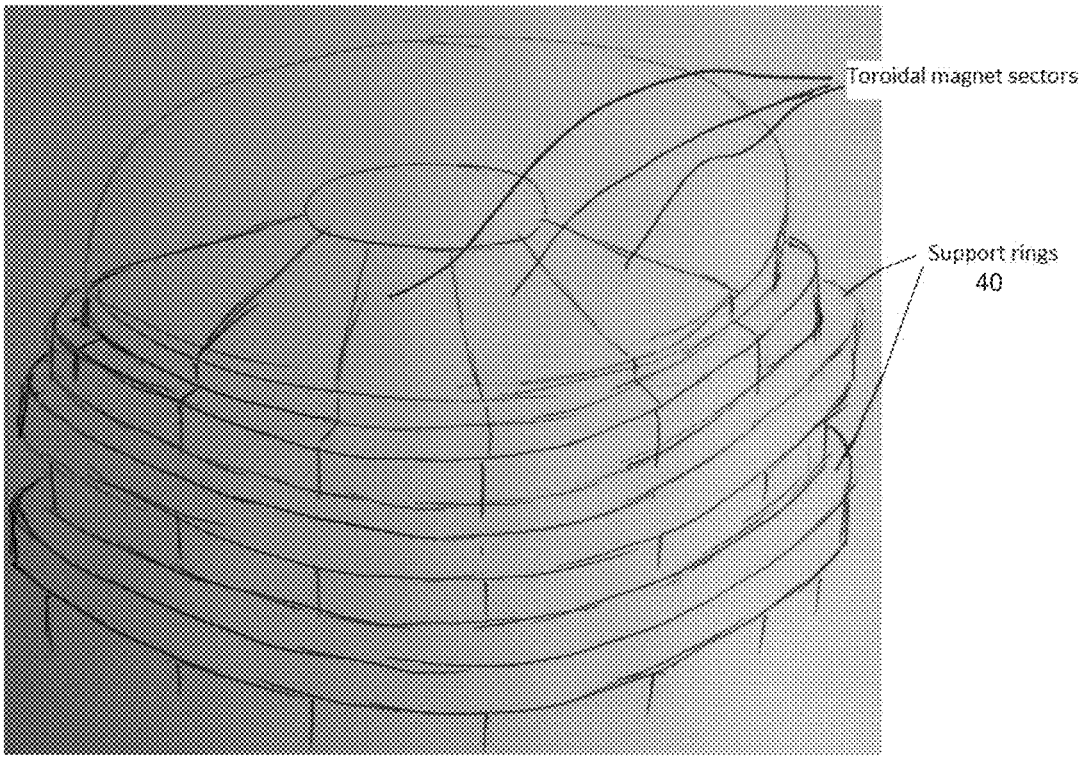
FIG. 7 shows a ring support for the outward loads of the outer leg of the torus.

For the radial loads, it would be possible to use radial ties between the inner and the outer coil surfaces, but a better way would be to use a bucking cylinder to support the throat of the magnet, and an outer support 40 for the outer legs of the magnet. The outer support 40 could be a cylinder or it could be a number of rings distributed through the outer leg of the magnet, as shown in FIG. 7. In the latter case, the support of the radial loads is similar to that used in present toroidal devices.

Figure 8:
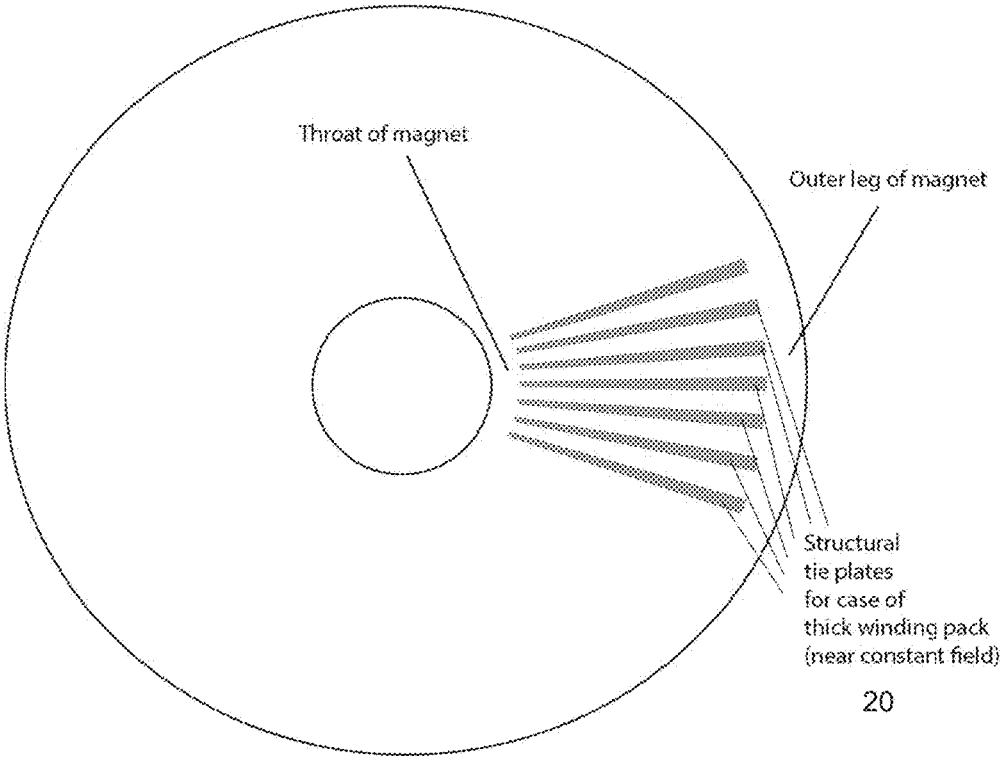
FIG. 8 illustrates structural tie-plates for use with thick conductor winding.

For the case of thick conductor winding, with constant magnetic field, the pressure is constant. In this case, the structure would be at constant stress if the thickness of the tie-plates 20 increases linearly with radius, as shown in FIG. 8. As before, instead of tie plates 20, it would be possible to use tie-rods or toroidally-aligned structures, as shown in FIG. 6, but with an effective cross section area of the structure that scales as the major radius (R). The cross sectional area of the elements and the number of elements need to be adjusted so that they would match the effective linearly increasing thickness of a tie-plate.

The structures in FIGS. 7 and 8 as shown as radial. There can be a combination of radial plates (with either constant or variable thickness in the radial direction) with structural ribs (fins). The ribs would be in the toroidal direction and attached to the radial plates or to the bucking cylinder (shown in FIG. 4). The ribs provide both structural support (that is, primary stress), as well as structural rigidity. The bucking cylinders 12 in FIG. 4, for example, can be made of a combination of hollow cylinders coupled with ribs. The cylinders provide support and radial centering load reaction, while the ribs provide both centering load reaction as well as prevent buckling.

Structural and Superconductor Configurations

For minimization of the weight, structural efficient magnets are required. Self-shielded magnets are also desired. The best solution would be to use bending free (also known as pure tension) toroidal magnets. This type of magnet designs have been used extensively in fusion application, to minimize the amount of structure required for containing the large forces associated with the high fields/stored energies in fusion experiment.

Figure 9:
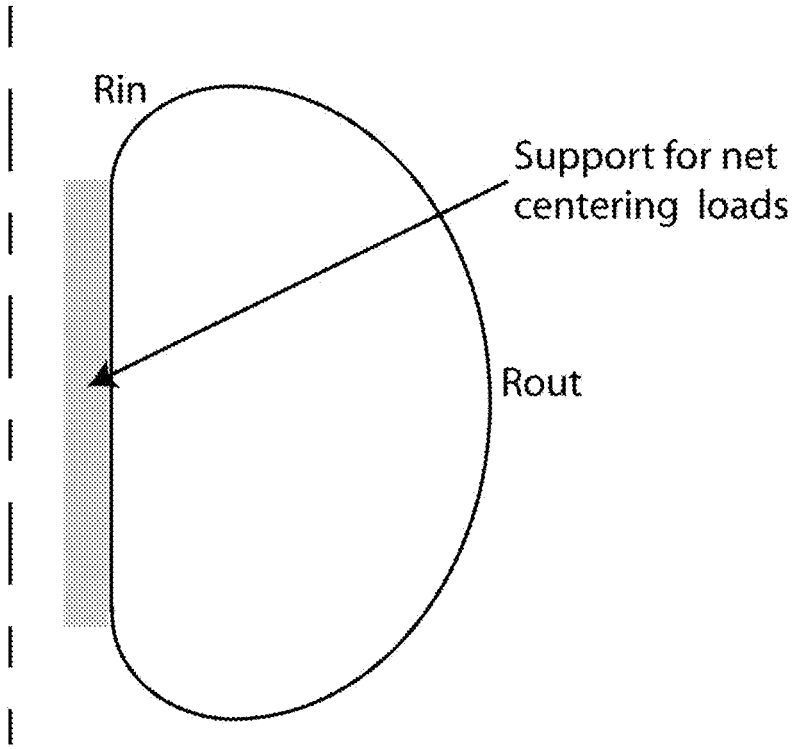
FIG. 9 is a schematic diagram of a constant tension (bending free) D-shaped coil.

FIG. 9 shows the general geometry (schematic) of a bending free (or pure-tension) magnet. It should be mentioned that if the outer region in the coil has no capacity to take bending (for example, made from a stack of HTS tapes), the shape that the coil will take is that of a D-shape coil. It is because of this feature that D-shape coils are very attractive for fusion or SMES applications! The toroidal magnet assembly is symmetric with respect to the machine axis, which is indicated by the dashed line toward the left hand side of FIG. 9.

Although D-shape magnets are suggested, other configurations are available, depending on where the radial loads are intercepted. Such configurations (combinations of C and D-shape coils) result in the best use of the superconductor and structure. It is expected that the required structure will be minimal, as the tapes themselves are very strong because of the Ni-alloy substrate. Structure will be needed, however, to take the net radially-inward load, produced by the higher magnetic loads in the inner leg of the coil compared to those acting on the outer leg.

The tape widths of the $2^{nd}$ generation superconductors need to be varied in order to achieve poloidal grading. The use of these tapes is cumbersome in some applications, but for the present application it is ideal. The tapes can be easily slit using laser cutting, and can be arranged such that the field is mostly parallel to the tape (in the a-b plane of the YBCO on the tapes), increasing the current carrying capability and minimizing the amount of superconductor required.

The use of constant tension magnets (bending-free magnets) allows the use of very strong materials for supporting the loads, allowing for decreased weights of the SMES. High performance fibers, such as Zylon and others, with tensile strengths on the order of 4-5 GPa, and relatively light weight (compared to metals) can be used to minimize the weight of the structure. There is a range of fibrous material that will be investigated. In addition to Zylon, there are carbon fibers and specialty polymers.

The structure (tie-plates, tie-rods, support rings, bucking cylinders) could be made out of a range of structural material, such as high strength aluminum, Inconel 625, or stainless steel. Alternatively, it can be made of a highly conducting material, such as copper or a copper alloy (including metal-matrix composites, such as GLIDCOP [SCM]). The tie-rod or the support rings could be made from high strength fibers discusses above.

Channels for cooling the magnets could be imbedded in the plates, with appropriate manifolding at region of easy access. For the inboard leg, which is the one with less access, the manifolding can take place at the bottom and top of the legs. This provides cooling of the magnets. The same arrangement can be used for the non-tapered section of the magnets (the horizontal legs and the outermost vertical leg).

It should be pointed out that, for example, carbon fibers have tensile strengths on the order of 3-4 GPa, while zylon has even higher (4-6 GPa, increasing with decreasing temperatures). The thickness of the required structure (which could be the Hastelloy in the tapes, if sufficient) can be calculated in the following manner: The net load in the upper region of torus is simply given by:

$$F=\pi(B_0R_0)^2/\mu_0 \ln(R_{out}/R_{in})$$

The lower region of the torus has a load with the same magnitude but reversed direction.

In this equation, $B_0$ is the magnetic field at $R_0$, and $R_{out}$ and $R_{in}$ are the outermost and innermost radii of the torus, respectively. Clearly, even for the illustrative case in Table 1, the thickness of the structure is small (about 1 cm, even for allowable stresses as low as 200 MPa).

Cryostat Considerations

Figure 10:
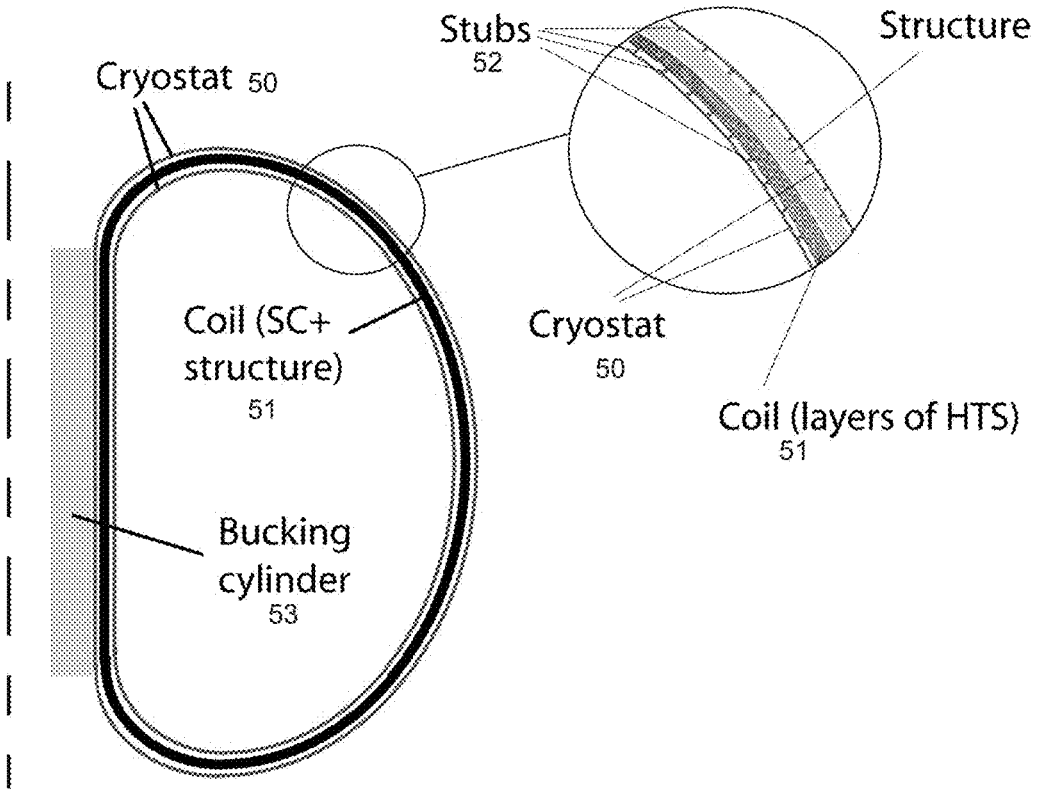
FIG. 10 illustrates a cryostat design that simplifies the cryogenic loads.

A double wall cryostat 50 could be used, especially for the case of thin winding pack. In this case, the cryostat is self-supporting, and the atmospheric loads on opposite sides of the coils roughly cancel each other. The atmospheric loads could be supported through the coil 51, as shown in FIG. 10 through the use of stubs 52 of small cross section, to minimize the heat leak. The size of the stubs 52 will be determined by the loads that need to be transmitted through the wall (in compression). The stubs 52 are made of materials that have low thermal conductivity, such as polymers or composites. They are in compression, allowing for large allowable stress, and thus, small cross section. The number and location of the stubs 52 need to be determined from detailed analysis. There is MLI (Multi layer insulation) in the gap between the shells to minimize the thermal radiation heat load (not shown in FIG. 10). When the coil is energized, the displacements due to the Lorenz loads will result in loads on the cryostat shell. The shell should be able to support these loads in tension.

Alternatively, the atmospheric loads are not supported by the coils. The loads can be reacted directly by the opposite face of the cryostat, without needing to go through the cold environment. Thus, it would be possible to react the room temperature side on the outer most surface with the loads in the innermost surface. The stubs 52 that support the loads, in this case, would have to pass through the cold environment (and thus, there will be radiation to the cold environment), but there is no direct thermal conduction to the cold environment. In this case, the thermal loads to the cryostat can be minimized by the use of MLI (Multi-laminar insulation) and by low pressure inside the cryostat (to minimize thermal convection)

In FIG. 10, the cryostat 50 does not include the bucking cylinder (the hollow cylinder in the throat of the magnet that supports the centering loads. It may be desirable to include the bucking cylinder 53 in the cryogenic environment. However, in this case, it would be necessary to disconnect the cryostat before moving one of the coils. Since it is not thought that the need for a coil removal will be a frequent operation, placing the bucking cylinder 53 inside the cryostat makes good sense.

It should be noted that the pressure inside the coil and outside the coil should be the same, in order to minimize the net load. This feature can be achieved by making either the coils discrete, each on its own cryostat, or with penetrations through the coils.

Optimization of the Topology

It has been estimated that for a machine with a 3 m OD, 3 m tall, the conventional solution with an inboard thickness of about 0.4 m (thin winding) would provide about 70 MJ of energy, the optimized winding would provide about 115 MJ (with an optimized inner radius of the coil), and the thick winding would provide about 300 MJ. These solutions are not optimized with respect to the weight or the amount of superconductor. In particular, the machine is too tall for the innermost turns of the thick winding to be very effective. A machine with an optimized height to radius would result in better performance (in terms of minimizing the amount of superconductor). The conductor optimizes for a machine with a height that is comparable to the radial width of the machine, or a height of about 1.5 m for the example provided above.

Although $2^{nd}$ generation has been mentioned, other superconductors (such as MgB2, NbTi, Nb3Sn, BSSCO 2212 or 2223, or others that have adequate current carrying capacity) operating at a range for temperature from 4 K to 77 K, can be used. In addition, temperature grading, where the higher fields are at lower temperatures and/or use one type of superconductor, and the outer turns, operating at lower fields, could be at higher temperature and/or use a different type of superconductor.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A superconducting magnet made from epitaxially deposited superconductor tapes, wherein a superconductor tape width is adjusted so that, when used in a toroidally wound magnet having a coil, the margin, defined as a ratio between the operating current and the critical current, is relatively constant throughout the coil.

2. The superconducting magnet of claim 1, wherein the superconductor tape width is adjusted from an inner leg to an outer leg, and is adjusted from an inner bore to a periphery.

3. The superconducting magnet of claim 1, wherein the superconductor tape width is adjusted from the inner bore of the magnet to the periphery.

4. The superconducting magnet of claim 1, wherein the superconductor tape width is adjusted from an inner leg to an outer leg.

5. The superconducting magnet of claim 1, wherein the superconductor is made from YBCO or ReBCO superconductor.

6. The superconducting magnet of claim 1, comprising one or more shells made from multiple shell sectors, and a plurality of radial plates connected mechanically or thermally for load and thermal management.

7. A superconducting toroidal magnet made from plates, wherein superconducting strands or cables are located in the plates such that a near constant magnetic field is produced within a winding volume, and the magnetic field is adjusted so that field peaking is decreased or eliminated by adjusting a radial distance between superconductor strands or cables in the plates.

8. The superconducting toroidal magnet of claim 7, wherein a thickness of the plates is adjusted to minimize the required structure and weight.

9. A superconducting toroidal magnet comprising multiple shells, wherein superconducting strands or cables are wound on each shell region in such a way as to produce a near constant magnetic field in the bulk of the coil, while preventing field peaking on a conductor region.

10. A superconducting toroidal field magnet having a bore, comprising:

a hybrid magnet made from one or more shells that produce a 1/r magnetic field in the magnet bore, where r is a radius of the magnet; and radial plates that provide currents required to maintain a near-constant magnetic field in the bore.

* * * * *